United States Patent [19]

Hatakenaka et al.

[11] 4,207,494

[45] Jun. 10, 1980

[54] MICROWAVE TUBES PROVIDED WITH PERMANENT MAGNET TYPE MAGNETIC CIRCUITS

[75] Inventors: Fujio Hatakenaka; Hisaaki Sato; Isamu Tsuchiya, all of Tokyo; Shigemoto Murata, Nagasaki; Yoji Morishita, Kawasaki, all of Japan

[73] Assignees: Nippon Electric Co., Ltd.; Nippon Hoso Kyokai, both of Tokyo, Japan

[21] Appl. No.: 889,119

[22] Filed: Mar. 22, 1978

[30] Foreign Application Priority Data

Mar. 24, 1977 [JP] Japan ..... 52/33067

[51] Int. Cl.[2] ..... H01J 23/08

[52] U.S. Cl. ..... 315/5.35; 315/5.38; 315/3.5

[58] Field of Search ..... 315/5.34, 5.35, 5.38, 315/3.5

[56] References Cited

U.S. PATENT DOCUMENTS

| | | | |
|---|---|---|---|
| 3,133,226 | 5/1964 | Buck et al. | 315/3.5 |
| 3,297,907 | 1/1967 | LaRue et al. | 315/3.5 X |
| 3,324,337 | 6/1967 | McCune et al. | 315/3.5 |
| 3,368,102 | 2/1968 | Saharian | 315/3.5 X |
| 3,394,282 | 7/1968 | Schmidt | 315/5.35 |
| 3,450,930 | 6/1969 | Lien | 315/5.38 |
| 3,930,182 | 12/1975 | Bretting | 315/5.35 |

*Primary Examiner*—Saxfield Chatmon, Jr.
*Attorney, Agent, or Firm*—Charles E. Pfund

[57] ABSTRACT

In a microwave tube of the type wherein an electron beam emitted by an electron gun is focused and caused to interact with an input high frequency wave at a high frequency circuit unit by magnetic flux generated by a permanent magnet type magnetic circuit, and the electron beam after the interaction is collected by a hollow cylindrical collector, a leakage flux generating means is provided near the entrance of the collector for generating leakage flux acting upon the electron beam. The leakage flux is produced by providing a notch for a pole piece adjacent to the collector and connected to the high frequency circuit unit or by reducing the cross-sectional area of the pole piece for magnetically saturating the pole piece itself or by keeping the pole piece in contact only with a portion of one end of the permanent magnet.

7 Claims, 10 Drawing Figures

MICROWAVE TUBES PROVIDED WITH PERMANENT MAGNET TYPE MAGNETIC CIRCUITS

BACKGROUND OF THE INVENTION

This invention relates to a microwave tube such as a klystron or a travelling wave tube, and more particularly a microwave tube provided with a permanent magnet type magnetic circuit for focusing an electron beam.

The prior art microwave tube of this type comprises an electron gun for emitting an electron beam, a high frequency circuit unit for causing an interaction between the electron beam and an input high frequency wave, a hollow cylindrical collector for collecting the electron beam after the interaction which is aligned in the axial direction, and a magnetic circuit including a permanent magnet for producing an axial flux in the high frequency circuit unit for focusing the electron beam. The electron beam emitted by the electron gun contributes to amplifying the input high frequency wave while travelling along the axis of the high frequency circuit unit in a state focused by the magnetic flux so as to give a part of the beam energy to the high frequency wave and is finally collected by the collector.

With the prior art construction described above, however, as the density of the axial flux produced by the magnetic circuit is low at a point near the entrance of the collector, focusing the electron beam is not enough so that the electron beam will be spread by space charge. As a consequence, substantial members of electrons collide against the collector near its entrance. Since the portions of the collector near its entrance are formed in a thin walled nozzle shape with small thermal capacity and small heat conductivity by taking into consideration the arrangement of the magnetic circuit, such portions will be overheated by the collision of the electrons thus evolving gas. In an extreme case these portions melt and come to contact with the magnetic pole piece comprising the magnetic circuit.

Of course, such overheating can be more or less alleviated by increasing the thickness of the portions of the collector near its entrance. However, when the thickness is increased toward inside, in other words, when the inner diameter of the collector is decreased, the secondary electrons generated by the collision of the electrons tend to move toward the high frequency circuit unit thus causing various troubles. On the other hand, when the thickness is increased outwardly, the outer diameter of the collector tip increases thus requiring to increase the outer diameter of the magnetic pole piece which is constructed similar to the collector and located near the collector tip. This increases the size of the focusing magnetic circuit as well as the weight and price. Especially, microwave tubes operating at a relatively high frequency and high power, require to have high flux density along the axis. For this reason, where it is necessary to increase the thickness of the pole piece, collector thickness also increases thereby increasing the size and cost of the magnetic circuit. As has been pointed out hereinabove, increase in the wall thickness at the collector entrance increases the number of electrons colliding upon the inner surface of the entrance thus increasing heat generation and moving back secondary electrons, and various expedients for preventing such overheating may be accompanied by a lot of sacrifice.

SUMMARY OF THE INVENTION

Accordingly, it is an object of this invention to provide an improved microwave tube provided with a permanent magnet type magnetic circuit and capable of preventing overheating caused by the collision of the electron beam against the portion of the collector near its entrance, and preventing secondary electrons emitted by the collector from tending to move toward the high frequency circuit unit.

Another object of this invention is to provide an improved microwave tube provided with a permanent magnet type magnetic circuit and capable of preventing overheating caused by the collision of the electron beam against the portion of the collector near the entrance thereof by merely modifying the prior art construction without utilizing any specific component parts and without increasing the size.

Still another object of this invention is to provide a novel microwave tube provided with a permanent magnet type magnetic circuit and capable of preventing overheating caused by the collision of the electron beam against the portion of the collector near the entrance thereof without modifying the prior art construction of the collector.

According to this invention, these and other objects can be accomplished by providing a microwave tube provided with a permanent magnet type magnetic circuit, comprising an electron gun for emitting an electron beam, a high frequency circuit unit for causing an interaction between the electron beam and an input high frequency wave, a hollow cylindrical collector for collecting the electron beam which has been subjected to the interaction, the electron gun, the high frequency circuit unit and the collector being aligned in the axial direction of the tube, and a magnetic circuit for producing axial magnetic flux through the high frequency circuit unit for focusing the electron beam, the magnetic circuit including a pair of pole pieces arranged at the opposite ends of the high frequency circuit unit, permanent magnets and yokes for magnetically interconnecting the pole pieces, and leakage flux generating means for generating leakage magnetic flux acting upon the electron beam near an entrance of the collector.

DESCRIPTION OF THE PREFERRED EMBODIMENTS

Figure 1:
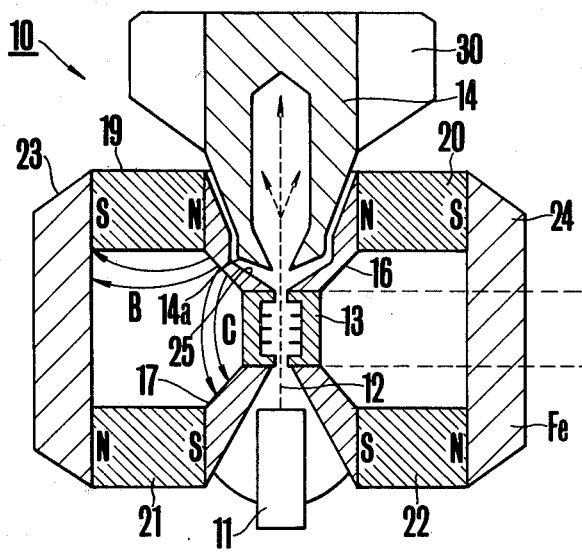
FIG. 1 is a longitudinal sectional view showing one embodiment of the microwave tube provided with a permanent magnet type magnetic circuit embodying the invention.

A microwave tube 10 shown in FIG. 1 comprises an electron gun 11 for emitting an electron beam 12 and a high frequency circuit unit 13 for effecting an interaction between the electron beam and an input high frequency signal. The high frequency circuit unit 13 comprises an beam path through which the electron beam passes, an input waveguide for receiving the input high frequency signal, and a plurality of cavity resonators, as is well known in the art. The microwave tube 10 further comprises a hollow cylindrical collector 14 for collecting the electron beam subjected to the interaction described above, a pair of pole pieces 16 and 17 disposed on the opposite ends of the high frequency circuit unit 13 and adjacent to the electron gun 11 and the collector 14 respectively, bar type permanent magnets 19 through 22 disposed on the outside of the pole pieces 16 and 17 and yokes 23 and 24 bridging the outer ends of the permanent magnets. The pole pieces, the permanent magnets and the yokes constitute a permanent magnet type magnetic circuit for producing an axial magnetic flux for focusing the electron beam for the high frequency circuit unit 13. The pole pieces are made of magnetic material such as iron and each comprises a square block having a cylindrical hollow portion in its inside and a nozzle like portion projecting from one end of said block toward the high frequency circuit unit. The inner ends of radially arranged permanent magnets are disposed to contact the outer surface of the cylindrical portion. Although not shown in FIG. 1, it should be understood that there are many pairs of permanent magnets.

According to this invention, the outer wall of the collector 14 near the tip of the collector through which the electron beam enters and the inner wall of the pole piece 16 facing thereto are constructed to have special configuration.

Figure 2:
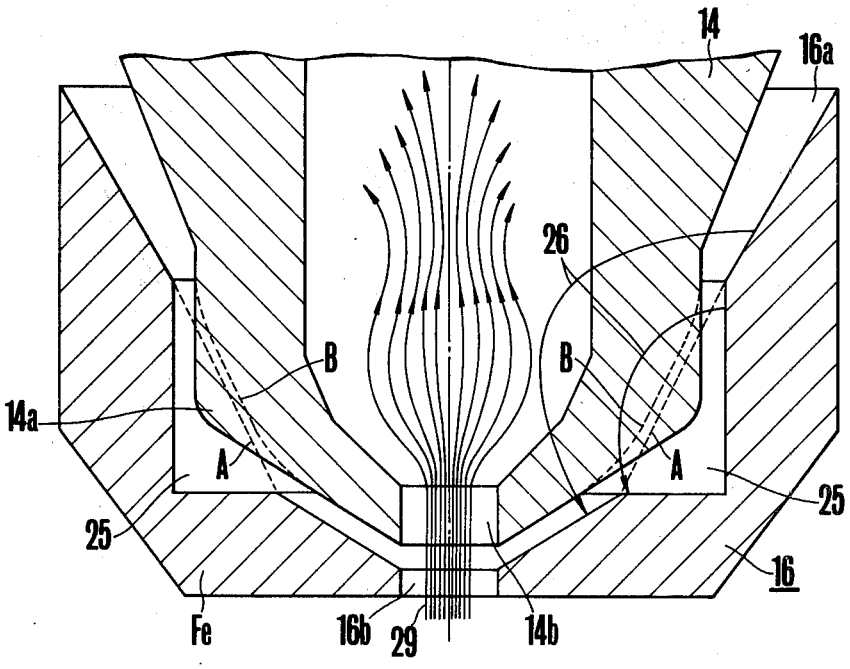
FIG. 2 is an enlarged sectional view showing portions of the collector near the entrance thereof and portions of the pole piece adjacent thereto.

More particularly, as shown in FIG. 2, the inner wall of the pole piece 16 inclines downwardly from the cylindrical opening 16*a* toward the opening 16*b* at the tip of the nozzle adjacent to the high frequency circuit unit 13 and a peripheral notch or shoulder 25 is formed at an intermediate portion of the inclined inner wall to face the outer wall of the collector 14 near the entrance of the electron beam. In this embodiment, the portion of the outer wall of the collector 14 is projected toward the notch 25 so as to form a projection 14*a*. In FIG. 2, dotted line A shows the contour of the pole piece before forming the notch while dotted line B the outside contour of the collector before forming the projection 14*a*.

Figure 3:
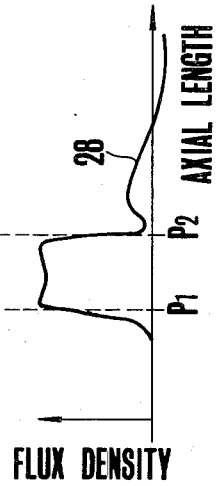
FIG. 3 is a graph showing the magnetic flux distribution along the tube axis.

As above described, according to this invention notch 25 is formed at an intermediate portion of the inner wall of the pole piece 16 to form a thin portion (small cross-sectional area) so that the flux produced by the permanent magnets 19 and 20 saturates whereby leakage flux is formed as shown by curves 26, with the result that the flux density distribution curve along the tube axis will have a peak 28 near the entrance of the collector 14 as shown in FIG. 3 in which $P_1$ and $P_2$ show the tips of the pole pieces 17 and 16. For this reason by forming the peak 28 at the entrance of the collector 14 where the electron beam 29 spreads, the electron beam is focused again by the leakage flux 26 that forms the peak 28 near the entrance of the collector and then reaches the inner portion of the collector. Since the heat radiating area is larger at the inner portion than at the entrance, there is no fear of overheating. In the case of an air cooled collector as in this example, since the inner portion is closely located to the heat radiating fins 30, cooling effect can be improved. Furthermore, provision of the projection 14*a* increases heat conduction thus efficiently preventing temperature rise of the collector.

The reason why the notch 25 provided for the pole piece saturates the magnetic flux at that portion to form leakage flux will now be theoretically analyzed.

Let us denote the residual flux density of the permanent magnet 19 by Br and the cross-sectional area of the permenent magnet 19 by Sm. Then, the total flux $\Phi$ generated by the permanent magnet is shown by $Sm \times Br$. However, all of the flux $\Phi$ does not reach the high frequency circuit unit 13 via the pole piece 16 to be utilized efficiently, but instead, a portion of the flux leaks through paths B and C as shown in FIG. 1. Taking a leakage coefficient of F(r), the flux $\Phi_A$ passing through a section A at a portion of the nozzle of the pole pieces 16 is expressed by $$\Phi_A = Sm \times Br \times F(r)$$

Where the yoke and pole piece are made of iron having a saturation flux density Bo, and where the required thickness of the nozzle of the pole piece at a radial portion r from the tube axis is denoted by t, $$\Phi_A = 2\pi r \cdot t \times Bo \cong Sm \cdot Br \cdot F(r) \qquad (1)$$
$$\therefore t = \frac{Sm}{2\pi r} \cdot \frac{Br}{Bo} \cdot F(r)$$

To form magnetic saturation at the notch 25, it is necessary to determine the thickness t to satisfy a relationship $$t < \frac{Sm}{2\pi r} \cdot \frac{Br}{Bo} \cdot F(r) \qquad (2)$$

But, as is well known in the art, different from an electric circuit, in a magnetic circuit, leakage occurs before saturation so that the optimum value can be found by experimentally determining the saturation.

Figure 4:
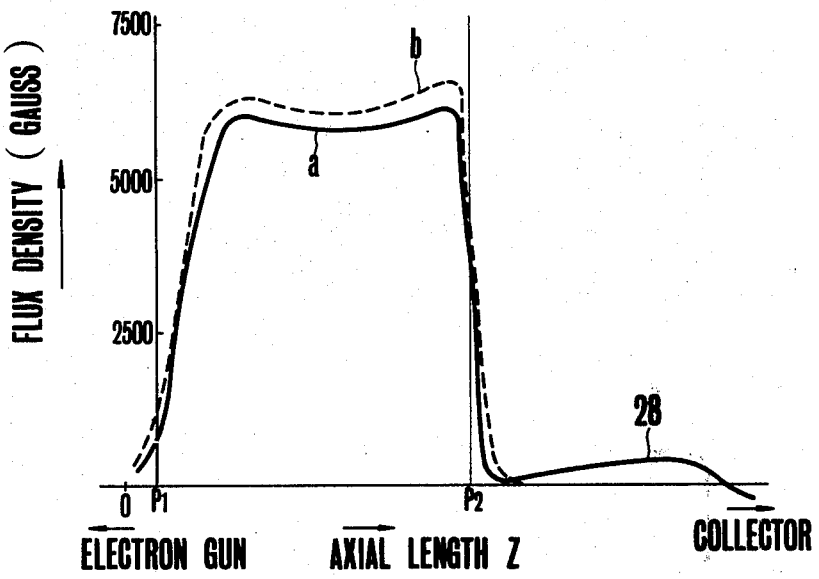
FIG. 4 shows the detail of the graph shown in FIG. 3 together with the flux distribution of a prior art microwave tube for comparison.

FIG. 4 shows the detail of the curves shown in FIG. 3 in which the ordinate shows the flux density Bz along the axis of the microwave tube and the abscissa the position Z along the axis. In FIG. 4, the characteristic of the microwave tube of this invention is shown by a solid line a, which shows that the flux density acting upon the high frequency circuit unit 13 is 5800 gausses at the center between two peaks and that the flux density at the collector caused by the leakage flux from the pole piece, that is the maximum flux density at the peak 28 is 400 gausses.

The dotted line curve b shows the characteristic of the prior art pole piece and collector (those shown by contours A and B in FIG. 2). Curve b shows that the flux density at the center between two peaks is 6050 gausses and that curve b does not contain any peak as curve a at the collector, thus failing to manifest the advantage of this invention.

Figure 5:
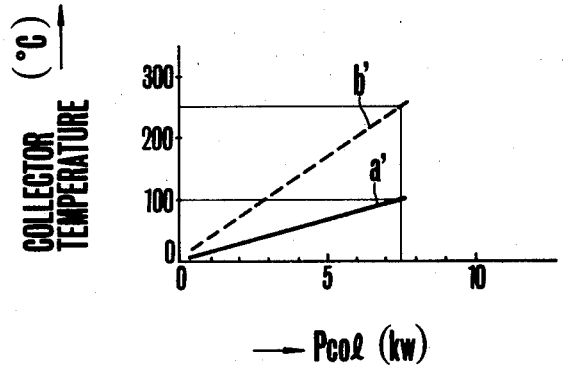
FIG. 5 is a graph showing the collector temperature-collector power loss characteristic curves of this invention and of the prior art.

FIG. 5 compares the characteristics of the prior art microwave tube and the novel microwave tube of this invention in which the ordinate shows the temperature of a definite point near the entrance of the collector (hereinafter merely designated as the collector electrode) and the abscissa shows the collector power loss Pcol. Curve a' shows the collector temperature characteristic of the microwave tube of this invention having the characteristic a shown in FIG. 4 and curve b' shows the collector temperature characteristic of the prior art microwave tube having the characteristic b shown in FIG. 4. The characteristics shown in FIG. 5 shows that the collector temperature of the prior art tube is 245° C. at a collector power loss of 7.5 KW and that the collector temperature of the microwave tube of this invention is only about 100° C. For this reason, it is possible to avoid melting of the collector due to abnormal heating encountered in the prior art tube.

Figure 6:
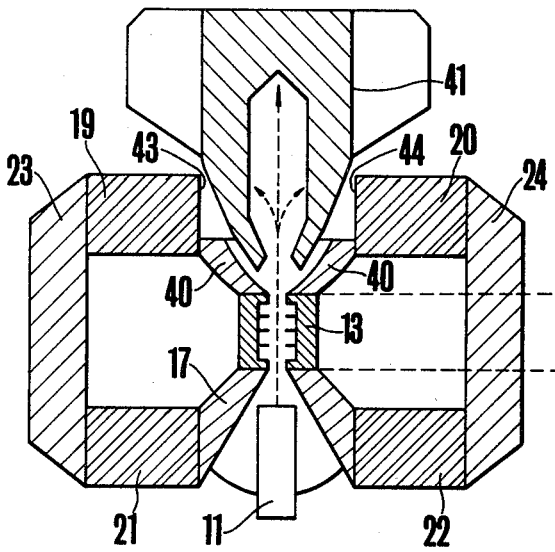
FIG. 6 is a longitudinal sectional view showing a modified embodiment of this invention.

In a modified embodiment shown in FIG. 6, the contact area between a pole piece 40 near a collector 41 and permanent magnets 19 and 20 is varied so as to prevent leakage flux from starting a portion of the end surfaces 43 and 44 of the permanent magnets 19 and 20 near the entrance of the collector 41.

In FIG. 6, elements corresponding to those shown in FIG. 1 are designated by the same reference characters. In this modification, the outer surface of the pole piece 40 contacts with only a portion of the end surfaces of the permanent magnets 19 and 20 so that the leakage flux that does not pass through the pole piece 40 flows from the remaining portions of the end surfaces 43 and 44 toward the collector 41.

Figure 7:
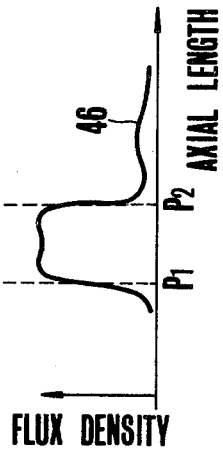
FIG. 7 is a graph showing the magnetic flux density distribution along the tube axis of the embodiment shown in FIG. 6.

FIG. 7 shows the flux density distribution along the tube axis when this construction is used. Similar to the embodiment shown in FIG. 1 a peak 46 occurs near the entrance of the collector. With this construction, it is possible to readily obtain desired leakage flux by merely changing the exposed areas of the end surfaces 43 and 44, thus making it easier to adjust the effect of the leakage flux upon the electron beam near the entrance of the collector than the construction shown in FIG. 1.

Figure 8:
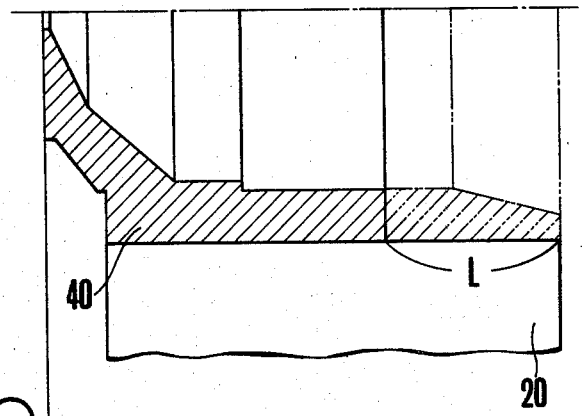
FIG. 8 is a cross sectional view of another embodiment of a pole piece structure for obtaining flux leakage.
Figure 9:
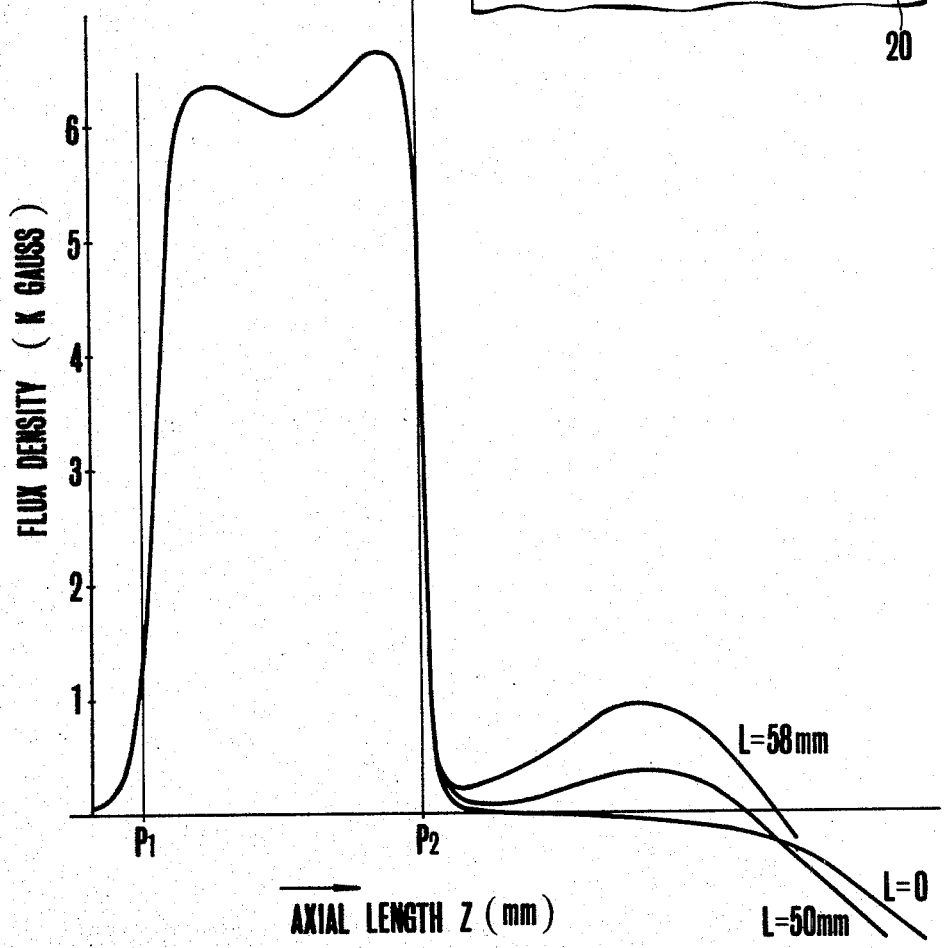
FIG. 9 is a graph showing the magnetic flux density distribution along the tube axis when the contact area between the pole piece adjacent to the collector and the permanent magnet, that is the contact length between the permanent magnet end surface and the pole piece is varied.

FIG. 9 is a graph showing the variation of the peak 46 when the contact area between the pole piece 40 and the permanent magnets 19 and 20 is varied. In this case, the cut length L of the pole piece 40 shown in FIG. 8 from the opening remote from the high frequency circuit unit was used as the parameter. The characteristic shown in FIG. 9 indicates that the height of the peak increases with the cut length. When cut length L=0, there is no peak as shown by the characteristic b in FIG. 4.

Figure 10:
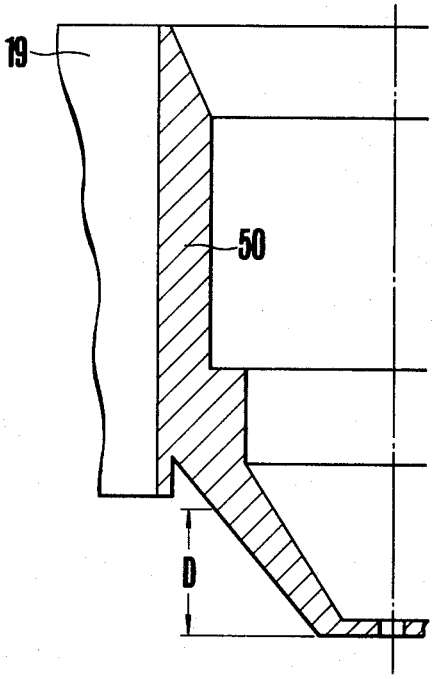
FIG. 10 is diagrammatic representation showing the pole piece adjacent to the collector and the permanent magnet according to further embodiment of this invention.

It should be understood that the invention is not limited to the illustrated embodiments. For example, for the purpose of generating the leakage flux, instead of forming a notch 25 as shown in FIG. 1, it is possible to gradually decrease the thickness of a region D of the pole piece 50 towards the tip as shown in FIG. 10 to reach a thickness which can produce the leakage flux shown by equation 2. Because of the gradually decreasing wall thickness of the region D, the flux is saturated at D.

Instead of forming the notch 25 all around the inner wall of the pole piece 16 as shown in FIG. 1, the notch may be discontinuous in which case the size and location of the notches can of course be varied as desired. Such notch can also be formed on the outer wall of the nozzle portion of the pole piece.

What is claimed is:

1. A microwave tube provided with a permanent magnet type magnetic circuit, comprising an electron gun for emitting an electron beam, a high frequency circuit unit for causing an interaction between said electron beam and input high frequency wave, a hollow cylindrical collector for collecting the electron beam which has been subjected to said interaction, said electron gun, said high frequency circuit unit and said collector being aligned in the axial direction of said tube, and a magnetic circuit for producing an axial magnetic flux of one polarity through said high frequency circuit unit for focusing said electron beam, said magnetic circuit including a permanent magnet and a pair of pole pieces arranged at the opposite ends of said high frequency circuit unit, and leakage flux generating means for generating leakage magnetic flux acting upon said electron beam near an entrance of said collector, said leakage magnetic flux being produced by said magentic circuit and forming a focussing peak having the same polarity with respect to said electron beam near the entrance to said collector as said axial magnetic flux.

2. The microwave tube according to claim 1 wherein said leakage flux generating means comprises means for magnetically saturating one of said pole pieces which is disposed to face said collector.

3. The microwave tube according to claim 2 wherein said one pole piece comprises a cylindrical member having an axial hollow portion, and a nozzle-like portion extending from one end of said cylindrical member toward said high frequency circuit unit with a tapered inner wall of said nozzle-like portion facing the electron beam entrance of said collector, said tapered inner wall being provided with a notch.

4. The microwave tube according to claim 3 wherein said notch extends over the entire periphery of said inner wall.

5. The microwave tube according to claim 3 wherein the portion of the outer periphery of said collector confronting said notch is projected outwardly toward said notch.

6. The microwave tube according to claim 3 wherein said pole piece comprises a cylindrical member and a nozzle shaped member extending from one end of said cylindrical member toward said high frequency circuit unit and having a tapered inner wall and said collector is inserted into said pole piece with its electron beam entrance opposed to said tapered inner wall, the wall thickness of said nozzle shaped member gradually decreasing toward the tip thereof thereby causing magnetic saturation.

7. The microwave tube according to claim 1 wherein each permanent magnet takes the form of a bar, one end of said magnet engaging a portion of the pole piece adjacent said collector with the portion of said one end not engaging said pole piece acting as said leakage flux generating means.

* * * * *